United States Patent [19]

Kammann, Jr. et al.

[11] Patent Number: 4,683,081

[45] Date of Patent: Jul. 28, 1987

[54] AQUEOUS CORROSION INHIBITOR COMPOSITIONS OF A HALF-AMIDE AND A DICARBOXYLIC ACID AMINE SALT

[75] Inventors: Karl P. Kammann, Jr., Crown Point; Kathleen A. Troxel, Griffith, both of Ind.

[73] Assignee: Ferro Corporation, Cleveland, Ohio

[21] Appl. No.: 879,682

[22] Filed: Jun. 27, 1986

[51] Int. Cl.[4] ..... C09K 3/00

[52] U.S. Cl. ..... 252/392; 252/49.3

[58] Field of Search ..... 252/49.3, 392

[56] References Cited

U.S. PATENT DOCUMENTS

| | | | |
|---|---|---|---|
| 3,969,236 | 7/1976 | Waldstein . | |
| 4,176,076 | 11/1979 | Waldstein . | |
| 4,273,664 | 6/1981 | Brandolese | 252/392 X |
| 4,344,862 | 8/1982 | Widder et al. . | |
| 4,379,063 | 4/1983 | Williams | 252/392 X |
| 4,388,199 | 6/1983 | Brandolese | 252/392 X |
| 4,405,494 | 9/1983 | Oppenlaender et al. | 252/392 |
| 4,425,248 | 1/1984 | Piotrowski et al. | 252/49.3 |
| 4,473,491 | 9/1984 | Trautmann et al. | 252/392 |
| 4,609,531 | 9/1986 | Ritschel et al. | 252/392 X |

FOREIGN PATENT DOCUMENTS

| | | | |
|---|---|---|---|
| 118799 | 6/1985 | Japan | 252/49.3 |

*Primary Examiner*—John F. Terapane
*Assistant Examiner*—Matthew A. Thexton
*Attorney, Agent, or Firm*—Philip Hill; Milton L. Simmons

[57] ABSTRACT

Improved low-foaming, water-soluble, rust-preventative compositions comprise a partial amide of an alkanolamine and unsaturated dicarboxylic acid, together with an aliphatic dicarboxylic acid salt of an alkanolamine.

16 Claims, No Drawings

AQUEOUS CORROSION INHIBITOR COMPOSITIONS OF A HALF-AMIDE AND A DICARBOXYLIC ACID AMINE SALT

BACKGROUND OF THE INVENTION

This invention relates to improved rust preventative compositions for use in low-foaming aqueous formulations. Such compositions comprise a partial amide of a selected alkanolamine and an unsaturated dicarboxylic acid, together with an alkanolamine salt of an aliphatic dicarboxylic acid.

Corrosion is a major problem in automotive and industrial systems where water is a likely component of liquid systems. While many anti-rust formulations have been marketed through the years, there remains a need for an economically attractive yet highly effective reagent system. Problems usually have involved limited water solubility, scum formation in hard water, extensive foaming, and the like. Water-based systems are generally preferred to hydrocarbon-based systems for reasons of cost and safety. A widely used corrosion inhibitor system comprises sodium nitrite and triethanolamine.

However, systems of the hydrocarbon-based and nitrite types pose environmental problems. Use of nitrite systems is of particular concern because of potential hazards in the work place due to possible generation of nitrosamines, particularly when used in metalworking applications where elevated temperatures develop from the friction of metal-to-metal contact. Replacement of nitrite reagents with monoalkanolamide borates is set forth in Waldstein U.S. Pat. Nos. 3,969,236 and 4,176,076. Another approach, employing sulfonamide derivatives, is described in Widder, et al., U.S. Pat. No. 4,344,862. The present status of water-based metalworking lubricants is reviewed by Hunz in *Lubricating Engineering,* vol. 40, no. 7, pp. 549–553 (1984).

In addition to their importance in water-based metalworking fluids, anti-rust applications range from corrosion inhibition in gasolines and fuel oils where water is a trace component to use in cooling systems employing water as a coolant or as a recycle stream. Other formulations find use in oil well drilling and in soluble oils.

SUMMARY OF THE INVENTION

This invention relates to compositions characterized as water-soluble, rust-preventative materials, generally comprising (a) a partial amide of an alkanolamine and an unsaturated dicarboxylic acid, (b) an aliphatic dicarboxylic acid, and (c) one or more alkanolamines, for provision, at least in part, of amine salts.

The corrosion inhibitor compositions of this invention possess improved water solubility characteristics in hard water as well as affording highly cost-effective anti-rust protection.

DESCRIPTION OF THE INVENTION

The improved anti-rust compositions of this invention provide economically attractive, water-soluble agents for use in aqueous formulations. One major ingredient of the compositions of this invention is a partial amide, prepared by reaction of an unsaturated dicarboxylic acid, having from about 10 to about 36 carbon atoms, preferably from about 19 to about 32 carbon atoms, per molecule with less than a stoichiometric amount of an alkanolamine.

The unsaturated dicarboxylic acid is preferably the condensation product of acids having reactive unsaturation. One such acid is the $C_{36}$ dimeric product obtained in the Diels-Alder reaction of two molecules of linoleic acid. Another such product is the $C_{21}$ product obtained by condensation of linoleic acid with acrylic acid under generally typical Diels-Alder reaction conditions.

The amine reactant may be a mono- or di-alkanolamine and have ethyl, propyl, butyl, or pentyl alkyl moieties. The alkyl groups of the alkanolamines include branched alkyl groups. Similarly, there may be more than one hydroxyl group present, as, for example, in 2-amino-2-ethyl-1,3-propanediol. Preferred are the dialkanolamines. The partial amide is typically selected to possess an average of from about 0.2 to about 1.2 amide groups per molecule.

A second major ingredient of the compositions of this invention is an aliphatic dicarboxylic acid, having from about 8 to about 20, preferably from about 10 to about 16 carbon atoms, per molecule. In a particularly preferred embodiment the acid groups are all terminal substituents, thus affording an $\alpha$, $\omega$-alkanedicarboxylic acid.

A third major ingredient of the subject composition is an alkanolamine, present in an amount at least sufficient to effect salt formation with the aliphatic dicarboxylic acid. One or more alkanolamines may be employed. Such alkanolamines may be mono-, di-, or tri-alkanolamines and the alkyl substituents thereof may be selected from ethyl, propyl, butyl, or pentyl groupings. Generally preferred are diethanolamine and triethanolamine. A preferred monoalkanolamine is 2-amino-2-methyl-1-propanol.

The compositions of this invention typically include a minor proportion of water, sufficient to provide ready miscibility together with a reasonably low viscosity.

When the compositions were diluted with water, to provide an additive concentration within the range from about 0.2 to about 0.8 wt. %, preferably about 0.5 wt. %, as when employed as metal-working coolants, hard water scums or precipitates did not form and little, if any, foaming was noted.

Generally preferred proportions of ingredients employed in the compositions of this invention include:

(a) from about 15 to about 40 weight parts of a partial amide mixture of an alkanolamine and an unsaturated dicarboxylic acid having from about 10 to about 36 carbon atoms per molecule;

(b) from about 10 to about 25 weight parts of an aliphatic dicarboxylic acid having from about 8 to about 20 carbon atoms per molecule;

(c) from about 20 to about 60 weight parts of a dialkanolamine;

(d) up to about 20 weight parts of a trialkanolamine; and (e) up to about 25 weight parts of water.

The following examples are illustrative, without limitation, of the anti-rust compositions of this invention.

EXAMPLE I

Thirty-eight weight parts of 1,12-dodecanedioic acid (DDDA) was added gradually over a period of 1 hour to 40 weight parts diethanolamine (DEA), held at a temperature of 160°–170° F. After all of the acid had dissolved, leaving a clear, homogeneous liquid, 6 weight parts triethanolamine (TEA) and 16 weight parts water were added with stirring to provide a uniform amine salt mixture. The amine salt composition (Product I), including some free amine, was then tested for its rust inhibition properties.

EXAMPLE II

The procedure of Example I was repeated, employing 41 weight parts DEA, 6 weight parts TEA, 14 weight parts water, and 19.5 weight parts of each of DDDA and an unsaturated $C_{21}$ dibasic acid, known in the trade as "WV-1550" and available from Westvaco Corporation. This amine salt composition of mixed dibasic acids (Product II), including some free amine, was tested for its rust inhibition properties.

EXAMPLE III

A mixture of 38 weight parts of the WV-1550 acid was added, as in Example I, to 62 weight parts DEA. The resulting amine salt (Product III), including some free amine, was tested for anti-rust properties.

EXAMPLE IV

The ingredients of Example II were employed in the same weight proportions, with the amine DEA and the dibasic acid WV-1550 first being heated together at 280°-300° F. until about 25% of the carboxyl groups reacted to form amide linkages, as indicated by a decrease in the acid value and confirmed by a decrease in the base value. The partial amide mixture was cooled to 150°-160° F. and the remaining ingredients were added. The mixture of amine salt and partial amide (Product IV), including some free amine, was tested for its anti-rust performance.

EXAMPLE V

A partial amide was prepared, employing 4 weight parts DEA and 19 weight parts dibasic acid WV-1550, by reaction at 260° F. The resulting decrease in acid value indicated 47% conversion of carboxyl groups although the decrease in base value indicated reaction of only 22% of the carboxyl groups to amide groups. The difference was presumably due to ester formation and IR analysis of the product showed strong absorption for both amide and ester groups.

To the 23 weight parts of partial amide, after cooling to about 160° F., was added an additional 36 weight parts DEA, 6 weight parts TEA, 18 weight parts DDDA, and 17 weight parts water. This mixture of amine salt and partial amide (Product V) was subsequently tested for anti-corrosion performance.

EXAMPLE VI

The anti-rust properties of the products from the preceding Examples I-V were evaluated by treating cast iron chips in a test solution (0.5 wt. % product+0.25 wt. % triethanolamine in tap water having a hardness rating of 8 grains per gallon as calcium carbonate) and then transferring to a filter paper, maintained under a Petri dish at 70°-75° F. for 18 hours. The filter paper was then inspected for rust spots.

A rating of 1 is given where the test exhibits only 1-4 small rust spots while a rating of 5 indicates the presence of 5-10 larger spots with 2-5 of these being of a wider-spreading type. None of the ratings indicate a poor product but are intended to distinguish outstanding products from merely good or acceptable products.

Test results for duplicate samples are presented in Table I.

TABLE I

| Product | Rust Inhibition Properties[a] Type | Rating |
|---|---|---|
| I | Salt | 4 |
| II | Salt | 4 |
| III | Salt | 5 |
| IV | Salt + Amide | 1 |
| V | Salt + Amide | 1 |

[a]Test procedure of Example VI.

Further observations on dilute (0.5 wt. %) aqueous solutions of the corrosion inhibitor compositions of this invention indicated that no scum formation or hard water precipitate occurred with Products IV and V, and very little foaming occurred with Product V, in contrast to results noted with amine salt compositions such as, for example, Product II.

We claim:

1. A water-soluble, rust-preventative composition, comprising:

(a) a partial amide of an alkanolamine and an unsaturated dicarboxylic acid having from about 10 to about 36 carbon atoms;

(b) an aliphatic dicarboxylic acid, having from about 8 to about 20 carbon atoms; and (c) at least one alkanolamine.

2. The composition of claim 1 wherein the alkanolamine is a dialkanolamine, selected from the class consisting of diethanolamine, dipropanolamine, dibutanolamine, dipentanolamine, and mixtures thereof.

3. The composition of claim 2 wherein the alkanolamine additionally comprises a trialkanolamine, selected from the class consisting of triethanolamine, tripropanolamine, tributanolamine, tripentanolamine and mixtures thereof.

4. The composition of claim 1 wherein the alkanolamine is a monoalkanolamine, selected from the class consisting of ethanolamine, propanolamine, butanolamine, pentanolamine, and mixtures thereof.

5. The composition of claim 1 wherein the partial amide contains from about 0.2 to about 1.2 amide groups per molecule.

6. The composition of claim 1 wherein the unsaturated dicarboxylic acid component of the partial amide contains from about 19 to about 32 carbon atoms per molecule.

7. The composition of claim 1 wherein the aliphatic dicarboxylic acid contains from about 10 to about 16 carbon atoms.

8. The composition of claim 1 wherein the aliphatic dicarboxylic acid includes solely terminal carboxylic acid substituent groups.

9. A water-soluble, rust-preventative concentrate composition, for use in aqueous corrosion inhibitor formulations, comprising:

(a) from about 15 to about 40 weight parts of a partial amide mixture of an alkanolamine and an unsaturated dicarboxylic acid having from about 10 to about 36 carbon atoms per molecule; and (b) from about 10 to about 25 weight parts of an aliphatic dicarboxylic acid having from about 8 to about 20 carbon atoms per molecule;

(c) from about 20 to about 60 weight parts of a dialkanolamine;

10. The composition of claim 9, additionally comprising up to about 20 weight parts of a trialkanolamine.

11. The composition of claim 9, additionally comprising up to about 25 weight parts of water.

12. The composition of claim 9 wherein the partial amide mixture consists of the reaction product of a dialkanolamine and an unsaturated dicarboxylic acid, said dicarboxylic acid having from about 19 to about 32 carbon atoms per molecule.

13. The composition of claim 12 wherein the dialkanolamine of the partial amide mixture is diethanolamine.

14. The composition of claim 9 wherein the aliphatic dicarboxylic acid molecule contains from about 10 to about 16 carbon atoms.

15. The composition of claim 9 wherein the dialkanolamine is diethanolamine.

16. The composition of claim 10 wherein the trialkanolamine is triethanolamine.

* * * * *